US006397918B1

(12) United States Patent
Chu

(10) Patent No.: US 6,397,918 B1
(45) Date of Patent: Jun. 4, 2002

(54) VENETIAN BLIND

(76) Inventor: Chen-Ho Chu, 6F, no. 2, Sec. 3, Min Sheng E. Rd., Taipei (TW)

( * ) Notice: Subject to any disclaimer, the term of this patent is extended or adjusted under 35 U.S.C. 154(b) by 0 days.

(21) Appl. No.: 09/812,589

(22) Filed: Mar. 21, 2001

(51) Int. Cl.[7] ..... E06B 9/26
(52) U.S. Cl. ..... 160/167 R; 160/170 R
(58) Field of Search ..... 160/168.1 R, 176.1 R, 160/167 R, 170 R, 178.3 R

(56) References Cited

U.S. PATENT DOCUMENTS 2,730,171 A * 1/1956 Clark
5,839,494 A * 11/1998 Judkins

FOREIGN PATENT DOCUMENTS

| | | | |
|---|---|---|---|
| CA | 868740 | * | 4/1971 |
| DE | 1909853 | * | 9/1970 |
| SE | 190270 | * | 6/1964 |

* cited by examiner

*Primary Examiner*—Blair M. Johnson
(74) *Attorney, Agent, or Firm*—Dennison, Schultz & Dougherty

(57) ABSTRACT

A Venetian blind includes a tilt means having multiple ladder strings for tilting slats of the blind connected to the ladder strings. Each of the ladder strings includes a front and a rear vertical strings, and a plurality of transverse ladders spaced between and along the front and the rear vertical strings. Upper ends of the two vertical strings are upward extended to provide a front and a rear hanging section, respectively, without any transverse ladders spaced between the hanging sections. Upper ends of the hanging sections are upward and movably extended through a tilter and then wound around a reel fixedly mounted on a rotary shaft in the head rail of the Venetian blind. The two hanging sections may be synchronously released from the reels when the rotary shaft is turned forward, so that the upper slats are lowered to a distance below the head rail of the blind, and a light transmissible area without being shielded by any slat is provided above the upper slats, and the lowered slats could still be deployed and tilted to adjust volume and direction of light projected through the blind.

4 Claims, 8 Drawing Sheets

VENETIAN BLIND

BACKGROUND OF THE INVENTION

The present invention relates to a Venetian blind, and more particularly to a Venetian blind having a tilt means with improved ladder strings, so that upper slats of the blind could be lowered to a distance below a head rail of the blind and a light transmissible area without being shielded by any slat is provided above the blind, and the lowered slats could still be deployed and tilted to adjust volume and direction of light projected through the blind.

A Venetian blind is widely welcomed because it has the functions of blocking sunrays, adjusting indoor brightness, decorating rooms, etc. As can be seen from FIG. 1, a conventional Venetian blind mainly includes a head rail 10, a bottom rail 20, a plurality of slats 30, a lift means 40 including multiple lift cords 41, and a tilt means 50 including multiple ladder strings 51. Typically, the lift cords 41 are laterally symmetrically provided on the blind to balance the bottom rail 20 and the slats 30 of the blind for them to be lowered or lifted synchronously. The number of ladder strings 51 depends on an overall width of the slats 30. The head rail 10 is fixedly attached to an upper edge 61 of a window 60. By pulling the lift cords 41, the bottom rail 20 and the slats 30 may be horizontally lifted or lowered relative to the head rail 10 as desired. For example, the slats 30 may be fully lowered to locate the bottom rail 20 immediately above a stool 62 of the window 60. At this point, all the slats 30 of the blind are deployed to shield entire area of the window 60, as shown in FIG. 2. Alternatively, the slats 30 may be partially lowered to locate the bottom rail 20 at any desired height above the stool 62 of the window 60. At this point, slats 30*a* at an upper part of the slats 30 are deployed while slats 30*b* at a lower part of the slats 30 are stacked on the bottom rail 20, as shown in FIG. 3. In either case of FIG. 2 or 30*a* in FIG. 3, the deployed slats 30*a* could be tilted upward or downward within 180 degrees through operation of the tilt means 50 to adjust the ladder strings 51. By tilting the above-mentioned slats to different angle of inclination, amount and direction of light projected into a room via the Venetian blind can be controlled and adjusted.

There may be many changes in the manner of operating the tilt means 50 and in the design of elements included in the tilt means 50. However, most of the tilt means 50 have similar operating principle. To be more specific, a front and a rear vertical strings 51*a*, 51*b* of each ladder string 51 are fixedly connected at their respective upper ends to a top center of a tilter, such that the front and the rear vertical strings 51*a*, 51*b* are separately located at front and rear sides of the tilter to face each other. The tilter is a lever-shaped rotatable member having two opposite arms. All the tilters are fixedly mounted on and horizontally spaced along the same one rotary shaft. The arms of the tilters have the same length and extend by a predetermined distance. By turning a tilt control bar 52 of the tilt means 50 clockwise or counterclockwise, or manipulating the tilt control bar 52 in other manner, the rotary shaft could be turned in two opposite directions by 90 degrees each, bringing the tilter to rotate along with the rotary shaft from a horizontal position to a vertical position. At this point, the front and the rear vertical strings 51*a*, 51*b* of the ladder strings 51 are ascended and descended, respectively, relative to each other, causing multiple spaced transverse ladders 51*c* of the ladder strings 51 extended between the front and the rear strings 51*a*, 51*b*, as well as slats 30*a*, 30*b* associated with the horizontal ladders 51*c*, to tilt by a desired angle. To lift the lowered bottom rail 20 and the previously deployed slats 30*a*, 30*b* to locate them immediately below the head rail 10, simply operate the lift means 40 and the tilt means 50 backward.

The lift means 40 and the tilt means 50, either manually or electrically operated, both have various types of designs available in the market. However, all these currently available lift means 40 and tilt means 50 for the conventional Venetian blind can only allow the bottom rail 20 and slats 30*a*, 30*b* of the slats 30 to be horizontally lowered to a desired height relative to the stool 62 of the window 60 and be lifted toward the head rail 10. That is, when the slats 30 is partially lowered, an area of the window 60 that is not shielded by any slat and is therefore completely light transmissible is always located below the bottom rail 20 and above the stool 62. However, in many cases, people usually need the blind to shield only a lower part or a middle part of a window and leave the remaining upper part of the window in a light transmissible state. It is obvious the conventional Venetian blind could not satisfy this requirement.

U.S. Pat. No. 5,443,108 entitled "Upwardly Deployed Privacy Blind" discloses a Venetian blind in which slats are stacked above the stool of the window when the blind is not in use or is partially lifted to provide a slat-free and light-transmissible area above the blind. This type of Venetian blind includes a fixed head rail, a fixed bottom rail, and an up and down movable middle rail, and therefore has more complicated structure. Moreover, the design of stacking slats at a lower part of the blind does not meet most people's practice of lifting and stacking the slats to an upper part of the blind when the blind is not in use.

There is a commercially available top-down pleated shade that includes a fixed head rail attached to the upper edge of the window, and a movable head rail connected to an upper edge of a pleated shade body. Through manipulation of operating elements inside the fixed head rail, the movable head rail and the pleated shade body may be lowered to separate from the fixed head rail, so that an area of the window below the fixed head rail and above the pleated shade body is not shield by the shade body and is therefore light transmissible. However, the movable head rail would extend across the window and forms a visual barrier when the pleated shade is lowered. The main difference between the top-down pleated blind and the top-down Venetian Blind is that the former needs only to lower the fablic away from the top head rail while the latter owns further function of tilting the slats in different angles.

It is therefore desirable to develop a top-down Venetian blind that overcomes the drawbacks existing in the conventional Venetian blinds and the pleated shade.

SUMMARY OF THE INVENTION

A primary object of the present invention is to provide a top-down Venetian blind that after the Venetian blind is fully or partly dropped, the upper portion of the slats could be lowered to a distance below the head rail of the blind and a light-transmissible area without being shielded by any slat is provided. A ladder string includes a front & a rear vertical strings connected with a plurality of horizontal ladders. Two extending cords of suitable length without horizontal ladders are connected to the tops of the front and the rear vertical strings of the ladder strings and pass through the tilting means and then wound around a reel mounted on a rotary shaft in the head-rail. The extended cords are synchronously released from the reel when the rotary shaft is turned forward, so that upper portion of slats are lowered to a distance below the head rail and a light transmissible area without being shielded by any slat is provided when the rotary shaft is turned backward the extended cords will be rewound around the reel and the upper portion of slats is lifted to the top of the blind.

Another object of the present invention is to provide a top-down Venetian blind in which the slats located below the light transmissible area but not stacked on the bottom rail would still be deployed and tilted to adjust volume and direction of light projected through the blind.

A further object of the present invention is to provide a top-down Venetian blind in which the tilter each includes two opposite lever arms provided with an end hole each. The upper ends of the hanging sections of the ladder string are separately upward extended through the end holes, turned to pass below a central shaft of the tilter, and then turned upward to connect to and wind around the reel. Whereby the hanging sections could be freely released from or rewound around the reel via the tilter without affecting tilting of the slats through the tilter and the ladder strings.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
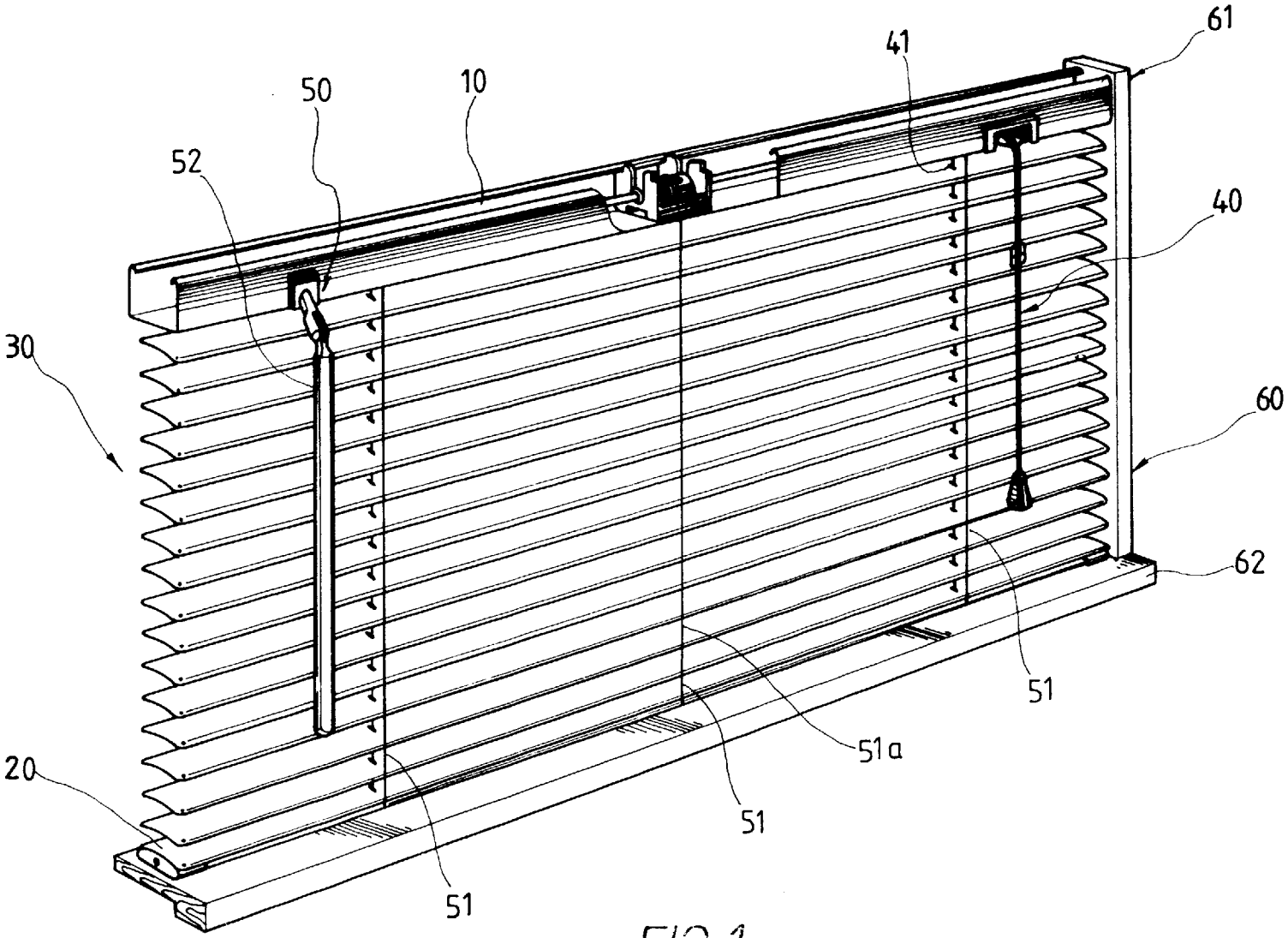
FIG. 1 is a perspective of a conventional Venetian blind being partially cut away to show a structure thereof.
Figure 3:
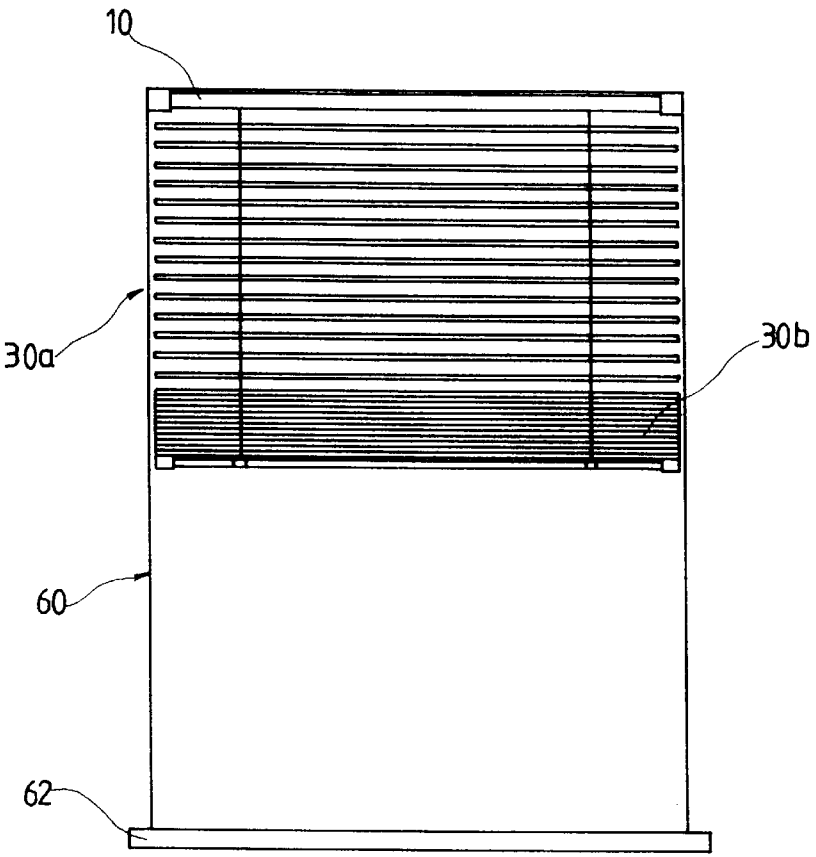
FIG. 3 is a front view of the conventional Venetian blind of FIG. 1 in a partially lowered state with the bottom rail thereof hanging halfway in a window.
Figure 2:
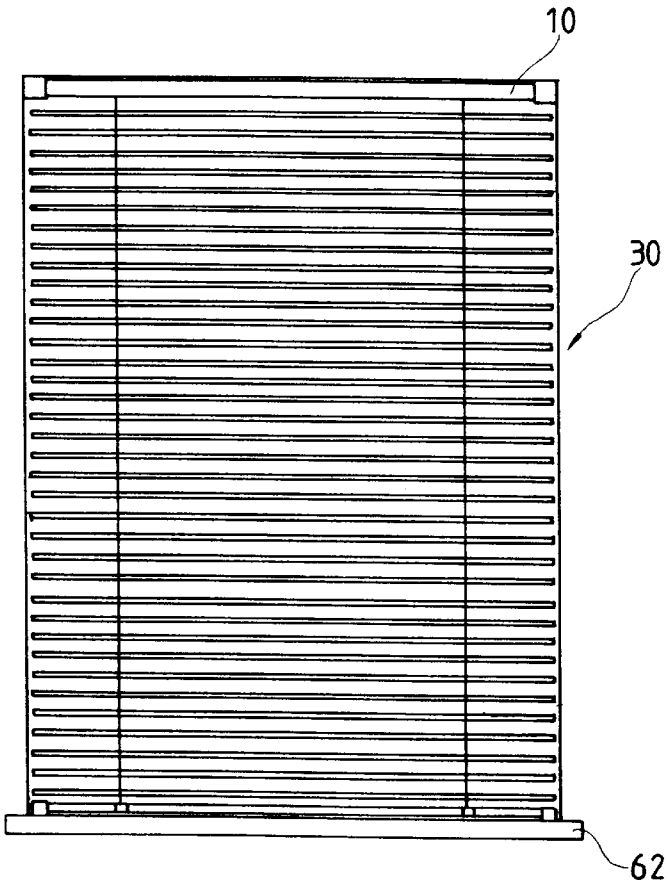
FIG. 2 is a front view of the conventional Venetian blind of FIG. 1 in a fully lowered state with a bottom rail thereof located immediately above a stool.

Please refer to FIGS. 6, 7, 8 and 9 in which a top-down Venetian blind according to a preferred embodiment of the present invention is shown. The Venetian blind of the present invention has a basic structure similar to a conventional Venetian blind as that shown in FIGS. 1, 2 and 3. In the following description with reference to the accompanying drawings, elements that are common in the Venetian blind of the present invention and the conventional Venetian blind will be denoted with the same reference numerals.

The top-down Venetian blind of the present invention mainly includes a head rail 10, a bottom rail 20, a plurality of slats 30 that are generally divided into upper slats 30*a* and lower slats 30*b*, a lift means 40 including a lift cord 41, a tilt means 50, and a rotary shaft 80. The tilt means 50 of the present invention is designed for the slats 30 to selectively and adjustably shield a whole area or only an upper, a middle or a lower area between an upper edge 61 and a stool 62 of a window 60 to which the Venetian blind is attached. As with the conventional Venetian blind, the tilt means of the present invention includes multiple ladder strings 51, each of which includes a front and a rear vertical strings 51*a*, 51*b*, and a plurality of transverse ladders 51*c* spaced along and between the two vertical strings. However, the ladder string 51 of the present invention is different from that of the conventional ones in that the front and the rear vertical strings 51*a*, 51*b* of the present invention are upward extended by a predetermined length to provide front and rear hanging sections 51*d* and 51*e*, respectively. Please note, unlike the front and the rear vertical strings, the front and the rear hanging sections 51*d*, 51*e* do not have any transverse ladders 51*c* spaced between them. The hanging sections 51*d*, 51*e* may have a length up to that of the vertical strings 51*a*, 51*b*, so that slats 30*a* in the upper part of the slats 30 could be fully lowered to stack above the stool 62 of the window 60. Detailed description concerning this portion will be made later.

The rotary shaft 80 of the present invention is mounted in the head rail 10 to associate with a transmission gear of prior art, so that a user could easily externally control the rotary shaft 80 to rotate in forward or backward direction to lower or lift the slats 30, respectively. The transmission gear is not limited to any specific structure and can be varied depending on actual needs. Since it is not a part of the present invention and could be done with regular mechanical skills, it is not discussed herein. Multiple reels 81 are fixedly provided on the rotary shaft 80 to each correspond to a ladder string 51. Free ends of the hanging sections 51*d*, 51*e* of each ladder string 51 are fixedly connected to the same point on the corresponding reel 81, such that the front and the rear hanging sections 51*d*, 51*e* could be synchronously released from or rewound around the reel 81 when the rotary shaft 80 is rotated in forward or backward direction, respectively. To be more specific, forward rotating of the rotary shaft 80 causes the front and the rear hanging sections 51*d*, 51*e* of all ladder strings 51 to be synchronously released from the reels 81 to vertically hang from the head rail 10 by a certain distance that can be controlled by the user; and, backward rotating of the rotary shaft 80 causes the front and the rear hanging sections 51*d*, 51*e* of all ladder strings 51 to be synchronously rewound around the reels 81 to shorten the distance by which the hanging sections 51*d*, 51*e* vertically hung from the head rail 10. In this manner, the front and the rear vertical strings 51*a*, 51*b* of the ladder strings 51 could always hold the slats 30*a*, 30*b* of the slats 30 in a horizontal position when the latter is lowered or lifted along with the released or rewound hanging sections 51*d*, 51*e*.

The tilt means 50 of the present invention also includes multiple tilters 53 corresponding to the multiple ladder strings 51 for tilting the slats 30*a*, 30*b* of the slats 30 to desired inclinations. The tilters 53 may employ the same operating manner as that of the tilter in the conventional Venetian blind. In the conventional Venetian blind, the front and the rear vertical strings 51*a*, 51*b* are fixedly connected at their upper ends to a corresponding tilter. However, in the present invention, the front and the rear hanging sections 51*d*, 51*e* above the vertical strings 51*a*, 51*b*, respectively, are movably wound through their corresponding tilter 53 instead of being fixedly connected thereto. To be more specific, each of the tilters 53 includes front and rear lever arms directed toward two opposite directions and provided with end holes 53*a* and 53*b*, respectively, and a central shaft 53*c*. Free ends (that is, upper ends) of the front and the rear sections 51*d*, 51*e* of each ladder string 51 are respectively upward extended through the end holes 53*a* and 53*b* of the tilter 53 and then turned downward to pass below the central shaft 53*c*. The hanging sections 51*d*, 51*e* are then turned upward from the central shaft 53*c* to wind around the reel 81 with their free ends fixedly connected to the same point on the corresponding reel 81, as having been mentioned previously. In this manner, the hanging sections 51*d*, 51*e* are movable relative to the tilter 53 when the rotary shaft 80 is rotated. That is, the hanging sections 51*d*, 51*e* are allowed to be freely released from or rewound around the reel 81 via the tilter 53 to vertically hang from the tilter 53 by different length, no matter whether the upper slats 30*a* of the slats 30 have been fully or partially lowered from the head rail 10. Since the upper slats 30*a* are connected to the front and the rear vertical strings 51*a*, 51*b* immediately below the hanging sections 51*d*, 51*e*, the upper slats 30*a* that have been deployed could still be tilted as desired through lever motion of the tilters 53 and thereby achieve the functions of deflecting incident light and adjusting indoor brightness. By releasing a desired length of the hanging sections 51*d*, 51*e* from the reels 81 via the tilters 53 just in a manner the same as that of lowering the blind of the conventional Venetian blind, the upper slats 30*a* of the slats 30 could be correspondingly lowered to a distance below the head rail 10 before or after being deployed. That is, an area 70 of the window 60 above the lowered upper slats 30*a*, that may be of any height corresponding to the released length of the hanging sections 51*d*, 51*e* under control, is not shielded by the slats 30*a* and is light transmissible. On the other hand, the lowered upper slats 30*a* could be lifted to locate immediately below the head rail 10 simply in a manner the same as lifting the slats of the conventional Venetian blind.

Figure 5:
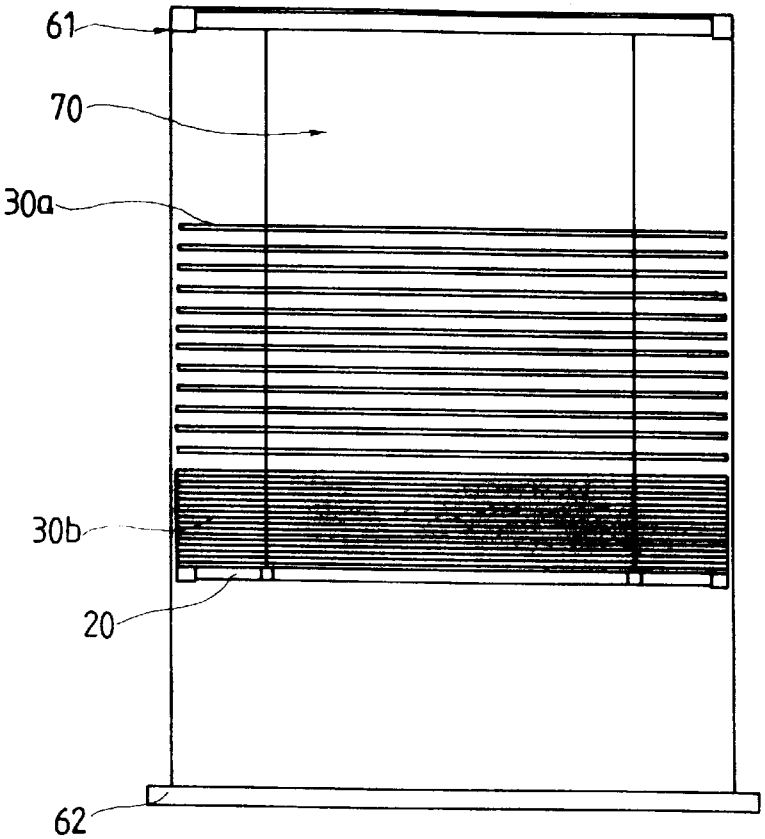
FIG. 5 is a front view similar to FIG. 4 but with a bottom rail of the Venetian blind hanging halfway in the window.
Figure 4:
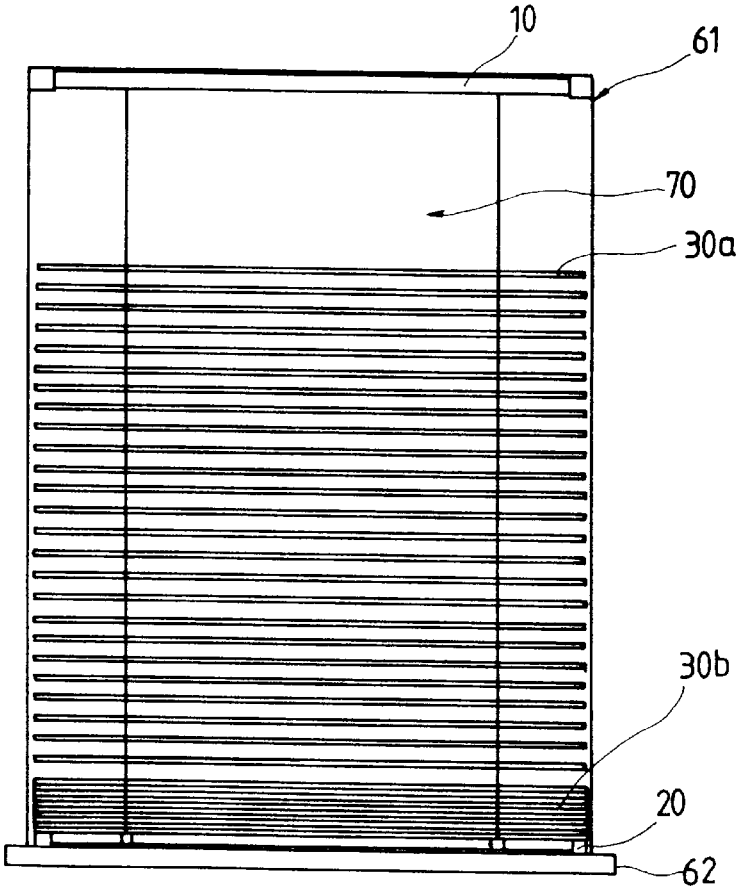
FIG. 4 is a front view of a Venetian blind of the present invention in a fully lowered state with a topmost slat located at a distance below a head rail thereof.
Figure 6:
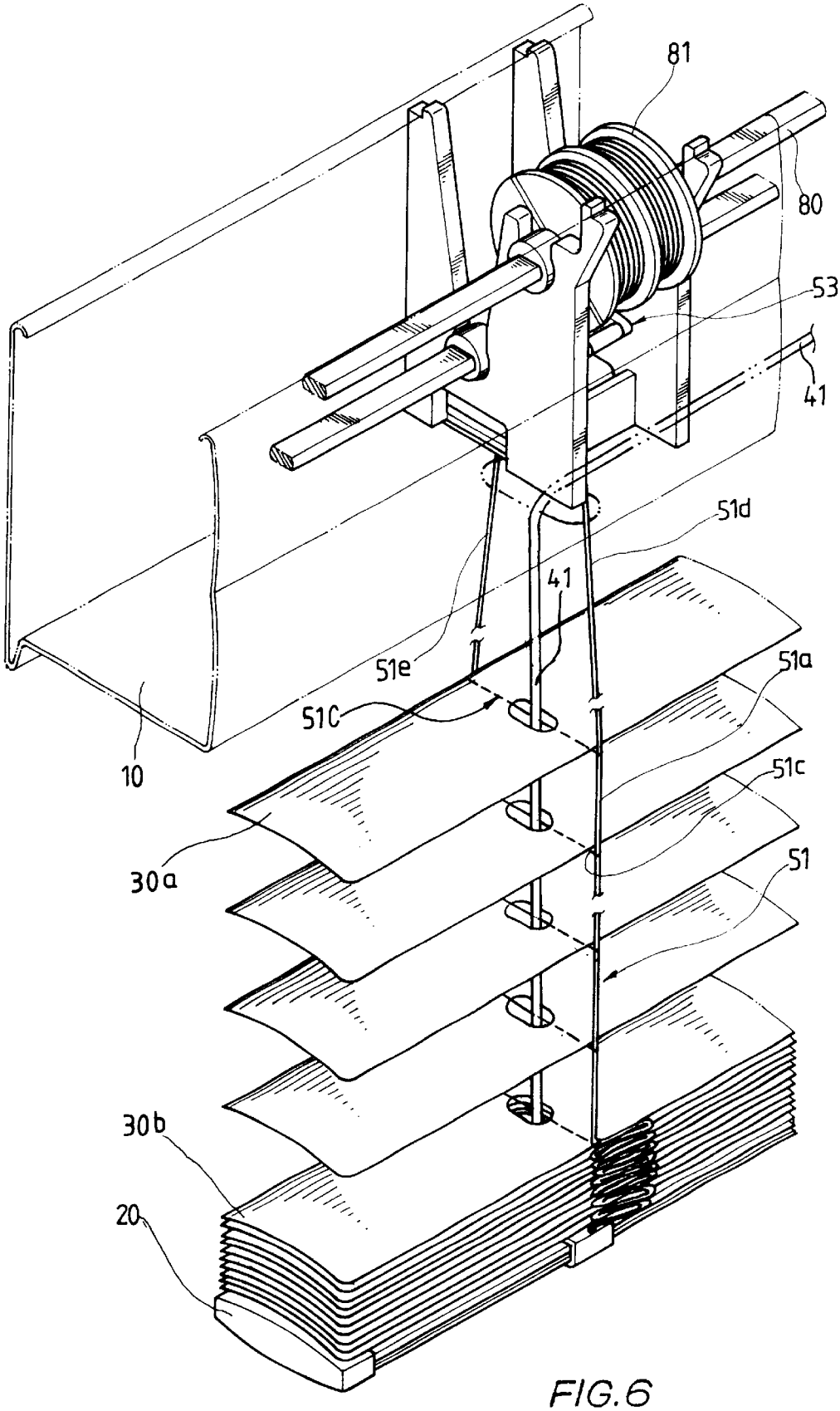
FIG. 6 is an enlarged, fragmentary perspective of a Venetian blind according to a preferred embodiment of the present invention with a part thereof cut away to show the structure thereof.
Figure 7:
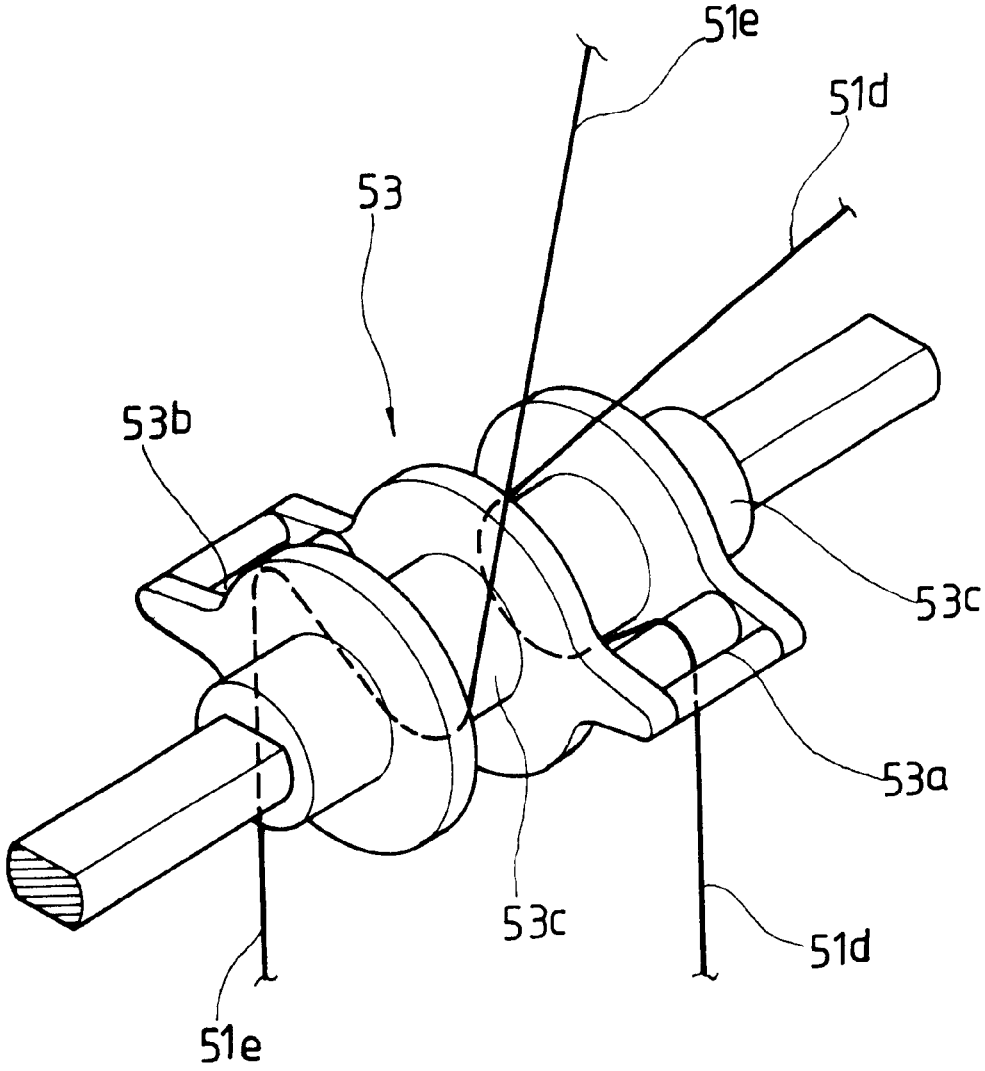
FIG. 7 is an enlarged perspective of a tilter of the Venetian blind of FIG. 6.
Figure 8:
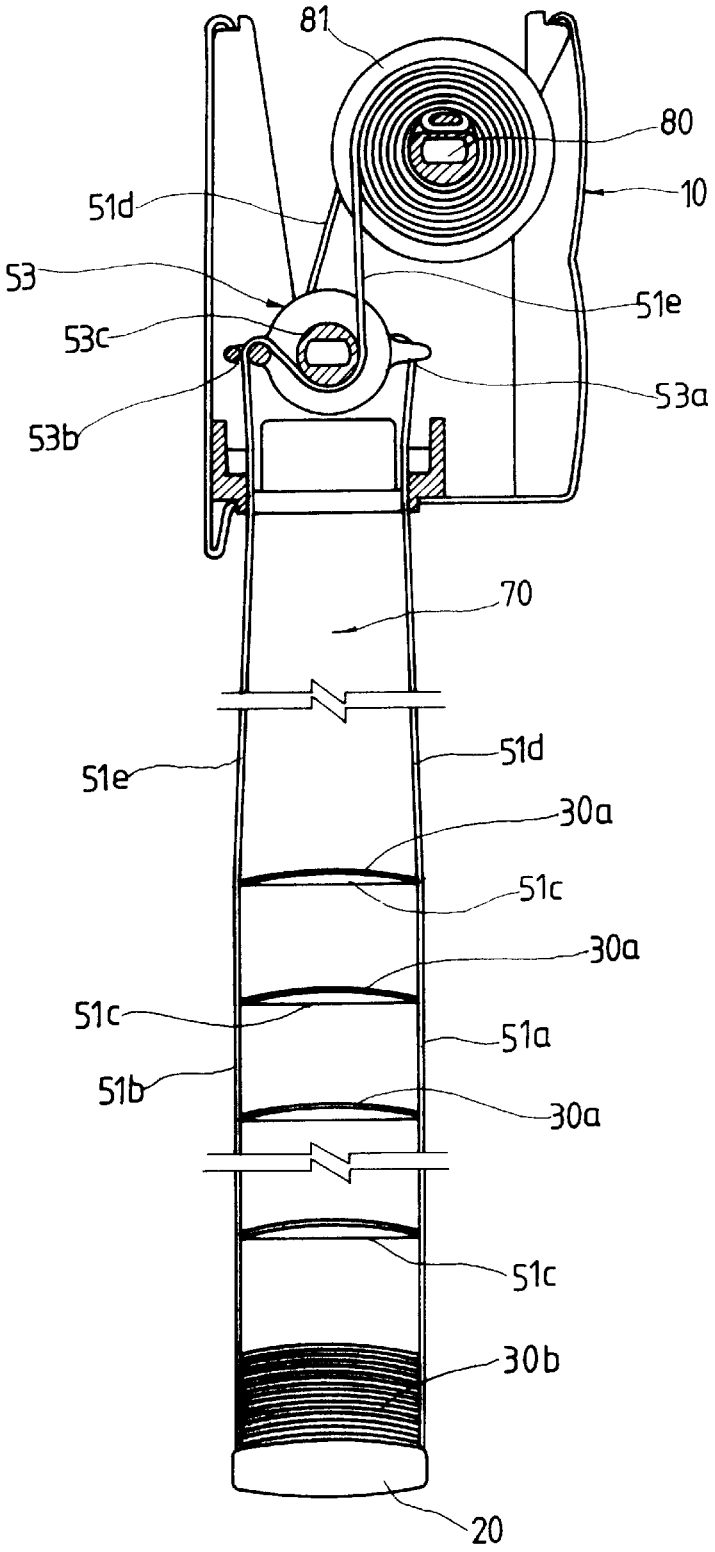
FIG. 8 is a side view of the Venetian blind of FIG. 6 with the slats thereof adjusted to a horizontal position.
Figure 9:
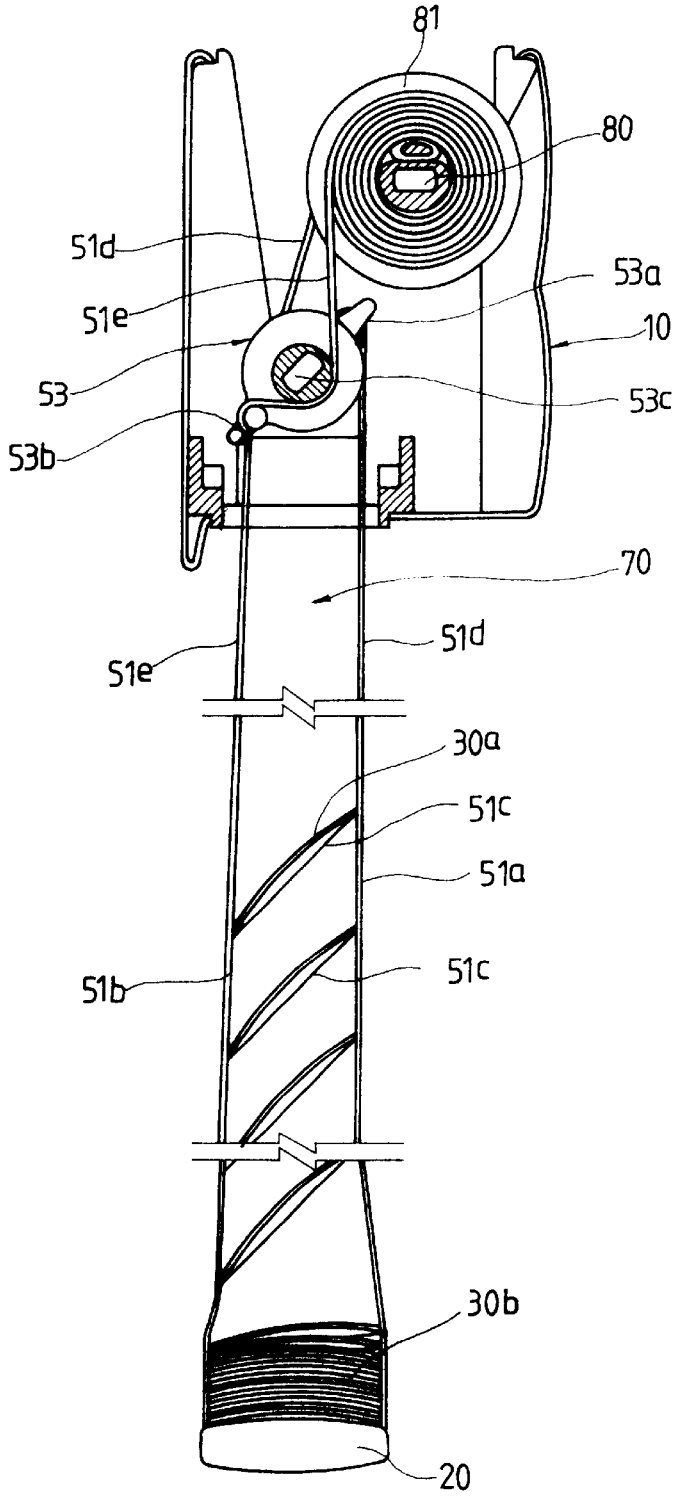
FIG. 9 is a side view of the Venetian blind of FIG. 6 with the slats thereof adjusted to a tilted position.

FIG. 4 shows the upper slats 30*a* of the slats 30 of the present invention are lowered to a distance below the head rail 10 to provide a light transmissible area 70 on the window 60. And, due to the existence of the light transmissible area 70, slats at a bottom part of the lower slats 30*b* are stacked on the bottom rail 20 above the stool 62 without being deployed. The number of the stacked lower slats 30*b* equals to that of upper slats 30*a* that are otherwise used to shield the light transmissible area 70. FIG. 5 is similar to FIG. 4 but with the bottom rail 20 hung on halfway in the window 60, so that an upper and a lower light transmissible areas are formed on the window 60.

As proven in tests conducted on prototypes of the Venetian blind of the present invention, the tilter 53 is not limited to any specific form and the size and the shape thereof may be changed, so long as the tilter 53 can achieve the same functions as described above. For example, the length of the lever arms of the tilter 53, the shape of the end holes 53*a*, 53*b* provided on the lever arms of the tilter 53, the diameter of the central shaft 53*c*, and the routing of the free ends of the hanging sections 51*d*, 51*e* below the central shaft 53*c*, all can be changed or modified, if the hanging sections 51*d*, 51*e* could be guided to turn at best positions toward desired directions to allow the tilter 53 to do lever motion and smoothly and effectively change the tilted angle of the slats 30*a* of the blind.

Figure 10:
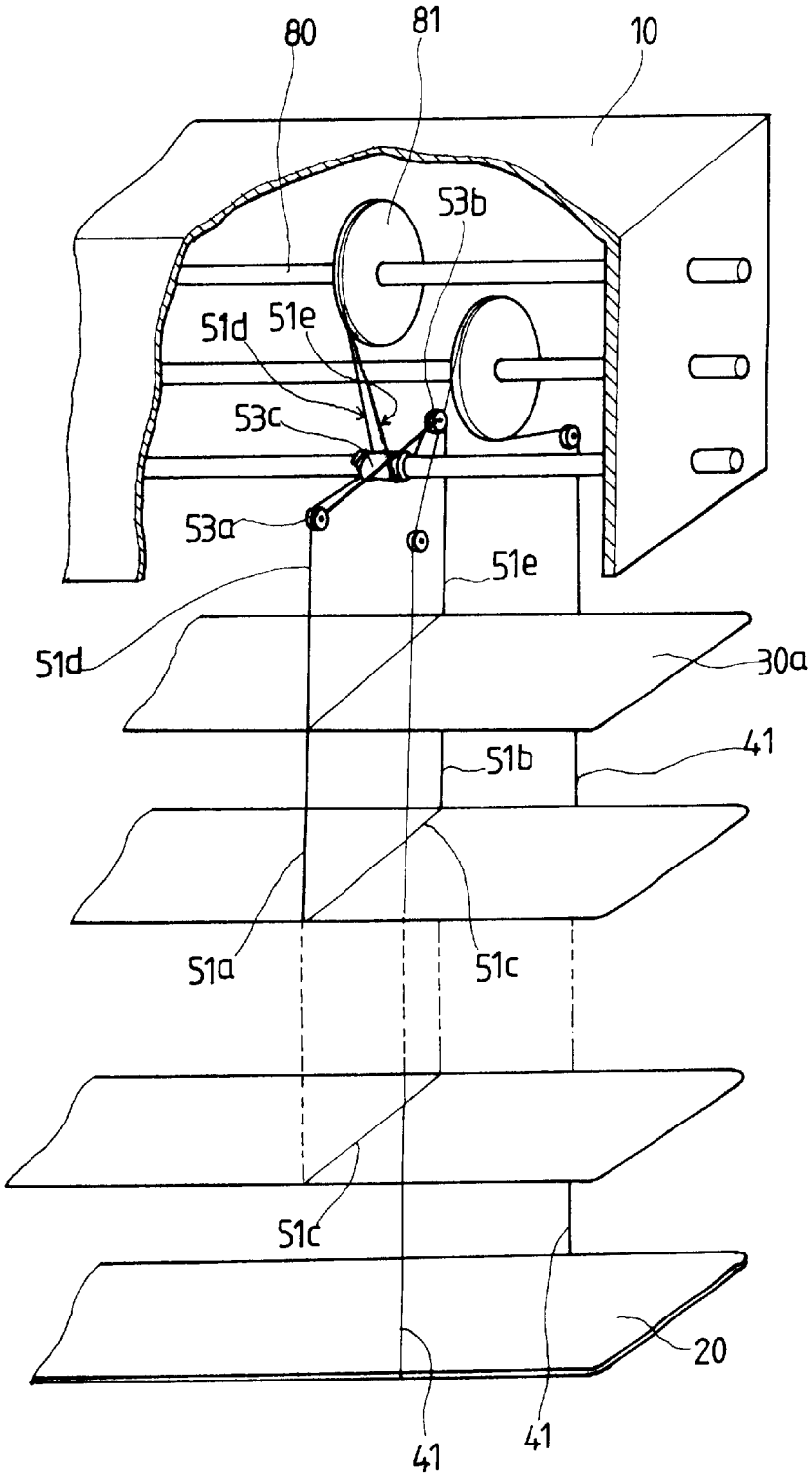
FIG. 10 is a fragmentary perspective of a Venetian blind according to another embodiment of the present invention with a part thereof cut away to show the structure thereof.

FIG. 10 is a fragmentary perspective of a top-down Venetian blind according to another embodiment of the present invention. Since this embodiment employ similar principle to achieve the same functions as the preferred embodiment, it is not described in details herein, and the same reference numerals are designated to denote the elements common in the two embodiments.

In addition to the above-mentioned functions, the Venetian blind of the present invention having the previously described structure also has at least the following advantages.

What is claimed is:

1. A Venetian blind comprising a head rail, a bottom rail, a plurality of slats located between said head rail and said bottom rail, a lift means controllable through a lift cord to lower or lift said blind while keeping said slats in a horizontal position, a tilt means including multiple tilters mounted in said head rail, and multiple ladder strings corresponding to said tilters, each of said ladder strings including a front and a rear vertical string and a plurality of transverse ladders spaced along and between said two vertical strings for adjusting tilt angles of said slats within 180 degrees, and a rotary shaft transversely extended across a top of said Venetian blind; said Venetian blind being characterized in that said front and said rear vertical sections of each of said ladder strings are upward extended by a predetermined length to provide front and rear hanging sections, respectively, without any of said transverse ladders spaced between said front and said rear hanging sections; upper or free ends of said front and said rear hanging sections of said ladder strings passing through said corresponding tilters in a predetermined manner and then fixedly connected to and wound around reels fixedly mounted on said rotary shaft, such that said front and said rear hanging sections can be synchronously released from or rewound around said reels; whereby by releasing a length of said front and said rear hanging sections from said reels, said upper slats are correspondingly lowered to a distance below said head rail before or after being deployed and a light transmissible area without being shielded by any of said slats is provided above said upper slats, and said upper slats located below the light transmissible area but not stacked on the bottom rail can still be deployed and tilted to adjust volume and direction of light projected through the blind.

2. A Venetian blind as claimed in claim 1, wherein said rotary shaft and said reels are mounted in said head rail.

3. A Venetian blind as claimed in claim 1, wherein said rotary shaft is associated with a transmission gear and could be externally manipulated by users to rotate in forward or backward direction to release or rewind said front and said rear hanging sections from or around said reels.

4. A Venetian blind as claimed in claim 1, wherein said tilters are spaced along a central shaft transversely mounted in said head rail, each of said tilters including two lever arms pointed toward two opposite directions and provided with an end hole each, and said upper or free ends of said hanging sections of each of said ladder string being separately upward extended through said end holes on said level arms of said corresponding tilter, wound around said corresponding reel fixedly mounted on the shaft; whereby said tilters permit said hanging sections to be freely released from or rewound around said reels without affecting the tilting of said slats through said tilters and said ladder strings.

* * * * *